United States Patent [19]

Vogel

[11] 4,187,790

[45] Feb. 12, 1980

[54] STEPPER DISK ADDER FOR PATTERN STITCH SEWING MACHINES

[75] Inventor: John D. Vogel, Brecksville, Ohio

[73] Assignee: The Singer Company, New York, N.Y.

[21] Appl. No.: 27,117

[22] Filed: Apr. 4, 1979

[51] Int. Cl.[2] ..... D05B 3/02; F16H 21/44

[52] U.S. Cl. ..... 112/158 E; 74/25; 74/99 R

[58] Field of Search ..... 112/158 E, 158 D, 158 R; 74/99 R, 25

[56] References Cited

U.S. PATENT DOCUMENTS

| | | | |
|---|---|---|---|
| 4,014,275 | 3/1977 | Herr et al. | 112/158 E |
| 4,074,641 | 2/1978 | Tholander et al. | 112/158 D |
| 4,103,632 | 8/1978 | Bowles | 112/158 E |

*Primary Examiner*—Peter P. Nerbun

*Attorney, Agent, or Firm*—Charles R. Lewis

[57] ABSTRACT

A stepper disk adder includes a plurality of adjacent disk like rotors that are threadedly coupled such that oscillation of at least some of the rotors in a predetermined manner provides a variable length reciprocating motion that is coupled to the stitch-forming instrumentalities of a sewing machine to provide predetermined stitch patterns.

12 Claims, 5 Drawing Figures

| $2^4$ | $2^3$ | $2^2$ | $2^1$ | $2^0$ | DISPLACEMENT (INCH) | |
|---|---|---|---|---|---|---|
| 0 | 0 | 0 | 0 | 0 | .000 | 1 |
| 0 | 0 | 0 | 0 | 1 | .010 | 2 |
| 0 | 0 | 0 | 1 | 0 | .020 | 3 |
| • | • | • | • | • | • | • |
| 0 | 1 | 1 | 1 | 1 | .150 | 16 |
| • | • | • | • | • | • | • |
| 1 | 1 | 1 | 1 | 0 | .300 | 31 |
| 1 | 1 | 1 | 1 | 1 | .310 | 32 |

STEPPER DISK ADDER FOR PATTERN STITCH SEWING MACHINES

BACKGROUND OF THE INVENTION

This invention relates to a disk type adder mechanism for converting digital binary numerical values into variable length reciprocating motion and more particularly to such adders for translating electrical pattern signals into movements of stitch-forming instrumentalities in a sewing machine to produce predetermined stitch patterns.

BRIEF SUMMARY OF THE INVENTION

Briefly described, the present invention includes a stepper disk adder having a plurality of adjacent, disk like, rotors having a common longitudinal axis of rotation. Each rotor has at least a pair of spaced apart, opposite polarity magnetic poles along the periphery thereof. A pair of spaced apart magnetic field producing coils are located adjacent the peripheral edge of each rotor. At least some of the rotors include an externally threaded portion extending along the longitudinal axis thereof that threadedly engages an internally threaded opening in an adjacent rotor. A source of actuating signals is coupled to each pair of coils to alternately actuate the coils thereby causing the associated rotor to oscillate between a first and second position defined by the location of the spaced apart coils. Oscillation of the rotors causes them to reciprocate along the longitudinal axis with the length of the reciprocation being determined by the number of, and the particular rotors that are caused to oscillate. One end of the plurality of rotors is restrained from reciprocating along the longitudinal axis and the other end which does reciprocate along the longitudinal axis is coupled to stitch-forming instrumentalities in a sewing machine.

DESCRIPTION OF THE DRAWINGS

This invention is illustrated in the accompanying drawings, in which like reference numerals designate like or corresponding parts throughout the several views, and wherein.

DESCRIPTION OF THE INVENTION

Figure 1:
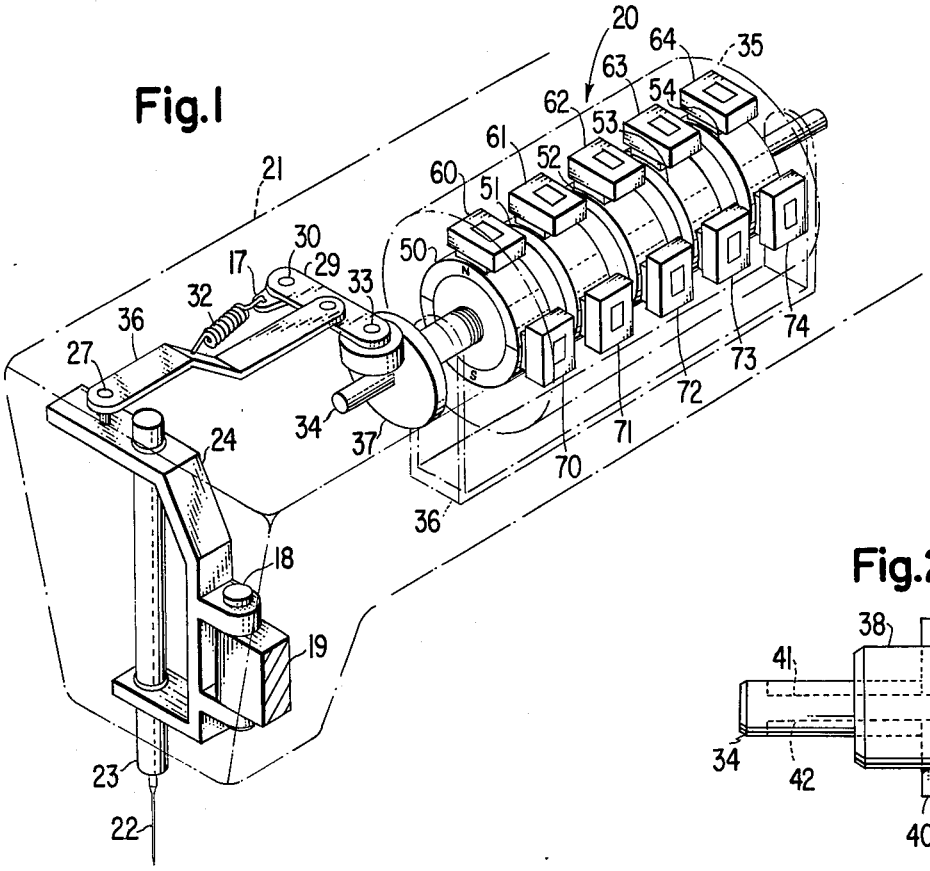
FIG. 1 is a perspective view of a portion of a sewing machine showing a stepper disk adder mechanism of this invention applied thereto to influence the position of lateral needle vibrations in the production of pattern stitches.

Illustrated in FIG. 1 is a stepper disk type adder, indicated generally as 20, in a sewing machine bracket arm 21 shown operatively connected to influence the lateral jogging or bight movements of a sewing machine needle 22 in the formation of a pattern of stitches.

The needle 22 is carried by a needle bar 23 journaled for edgewise reciprocation in a gate 24 which is pivotally mounted for lateral swinging movement by means of a pivot pin 18 and a block 19 secured to the bracket arm 21. An arm shaft (not shown) in the bracket arm 21 may be connected by any conventional means to impart endwise reciprocation to the needle bar 23. The needle bar gate 24 is shifted laterally about the pivot pin 18 to impart zigzag movements to the needle 22 by means of a link 26 pivoted as at 27 to the gate 24 and pivoted at 28 to a follower lever 29 fulcrumed at 30 in the bracket arm 21 and having a roller 31 journaled at its free extremity. A spring 32 may be arranged between the link 26 and the bracket arm 21 of the sewing machine frame by means of a tab 17 to urge the roller 31 to the right, as viewed in FIG. 1, against an actuating member 37 secured to the stepper disk adder 20. The lateral position of the needle bar gate 24 is determined by the position of the actuating member 37 which is controlled by the stepper disk adder 20 in a manner described hereinbelow in detail. It will be appreciated that the lateral position, or angular position, about the pivot pin 18 of the needle gate 24 during work penetration by the needle 22 will determine the lateral placement of each stitch, and therefore, the pattern in which zigzag stitches are formed.

Figure 2B:
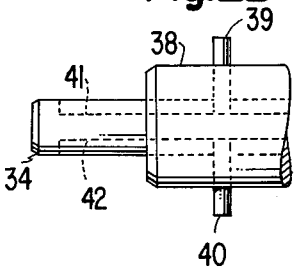
FIGS. 2A & 2B are partial cross-sections of the stepper disk adder of this invention.
Figure 2A:
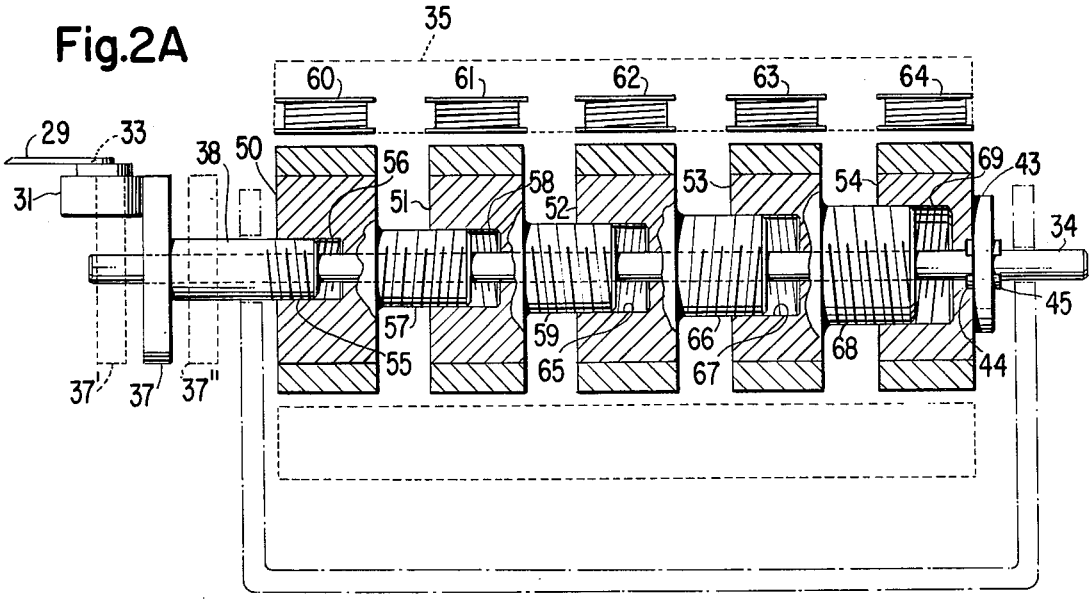

The stepper disk adder 20 of this invention is illustrated in FIGS. 1 and 2A as secured within the bracket arm 21 and including a frame or housing (schematically illustrated for purposes of clarity) that has a first portion 35 to which a plurality of magnetic field producing coils or electromagnets 60–64 and 70–74 are secured and a second portion 36 to which a nonrotatable shaft 34 is secured.

Rotatably mounted on the shaft 34 are a plurality of disk like rotors 50–54. The rotors 50–54 may be fabricated from a magnetic material or a nonmagnetic material. If a nonmagnetic material is used, the outer periphery of each rotor 50–54 has an annular ring of magnetic material secured thereto as shown. Each rotor is magnetized, in a well known manner, to have a north N and a south S magnetic pole spaced apart by about 180° along the outer periphery thereof as shown in FIG. 1. Some of the rotors 50–54 include an externally threaded portion extending along the longitudinal axis of the shaft 34 which threadedly engages an internally threaded opening in an adjacent rotor. For example, rotors 50–53 have extending portions 57, 59, 66 and 68, respectively, that threadedly engage internally threaded portions 56, 58, 65, 67 and 69 in rotors 51–54, respectively. An externally threaded actuating member 38 slidably mounted on the shaft 34 threadedly engages an internally threaded opening in rotor 50. The threadedly engaged members are alternated to have left hand threads and right hand threads and have a different number of threads per unit length in a manner as described hereinbelow in detail.

A retaining member 43 is rotatably but nonslidably secured to the shaft 34 at one end of the adjacent rotors 50–54 by any suitable means, such as two snap rings 44 and 45 which engage grooves (not shown) in the shaft 34 on each side of the retaining member 43, in a well known manner. The retaining member 43 is secured to the rotor 54, by any suitable means (not shown), to prevent the rotor 54 from reciprocating along the length of the shaft 34. At the other end of the adjacent rotors 50–54, a member 38 is slidably but nonrotatably secured to the shaft 34. This is accomplished, as shown in FIG. 2B, by pins 39 and 40 secured to the member 38 that extend into and engage longitudinal slots 41 and 42, respectively, in the shaft 34 that enable the member 38 to reciprocate along the length of the shaft 34 but prevent the member 38 from rotating around the shaft 34. Secured to the member 38 for movement therewith is actuating member 37 that controls the sewing machine stitch-forming instrumentalities described hereinabove.

A pair of coils, or electromagnets, 60 & 70, 61 & 71, 62 & 72, 63 & 73 and 64 & 74 are associated with each of the rotors 50, 51, 52, 53 & 54, respectively, and are located adjacent the periphery of the associated rotor and spaced apart by about 90° as shown in FIG. 1. Applying current to any of the coils 60–64 and 70–74 causes it to produce a magnetic field adjacent to the periphery of the associated rotor 50–54. For example, assume that current is applied to coil 60 associated with the rotor 50 in FIG. 1 and that a south magnetic field pole is thus produced adjacent to the rotor 50. Since the north N pole of the rotor 50 is located beneath the coil 60, the rotor 50 will be held stationary since the unlike magnetic poles attract one another. Assume now that the current is removed from coil 60 and is applied to coil 70. The coil 60 no longer produces a magnetic field but the coil 70 now produces a south magnetic field pole that attracts the north magnetic pole N of the rotor 50 thereto. Accordingly, the rotor 50 will rotate clockwise (as shown in FIG. 1) until the north magnetic pole N thereon is under the coil 70. By alternately actuating the coils 60 and 70, the north magnetic pole on the rotor 50 can be caused to oscillate between the coils 60 and 70 thereby causing the rotor 50 to oscillate in an arc of about 90°. Because of the threaded engagement of rotor 50 with the member 38 and rotor 51, such oscillation causes the rotor 50 to reciprocate along the longitudinal axis of the shaft 34. This reciprocating motion is imparted to the actuating member 37 to actuate the stitch-forming instrumentalities of the sewing machine described above. Because of the retaining member 43, all of this reciprocal motion takes place to the left of the retaining member 43 as shown in FIG. 2A.

By oscillating the remaining rotors 51–54 in a like manner, the length of the reciprocating motion applied to actuating member 37 can be varied with the length of the reciprocating motion being determined by the number of and the particular rotors 50–54 that are oscillated. Each of the plurality of adjacent rotors 50–54 can be considered to a single digit of digital binary number with rotor 50 being the least significant digit and rotor 54 the most significant digit with a binary one at any digit position placing the north N magnetic pole of the associated rotor 50, 51, 52, 53 or 54 below its coil 60, 61, 62, 63 or 64 and a binary ZERO placing the associated rotor 50, 51, 52, 53 or 54 below its associated coil 70, 71, 72, 73 or 74. In one embodiment, the length of the reciprocating motion applied to the actuating member 37 is variable by one hundredth of an inch increments. This was achieved by oscillating each rotor in an arc of about 90°, providing threaded member 37 and opening 56 with seventy five right hand threads per inch, portion 57 and opening 58 with thirty seven and a half left hand threads per inch, portion 59 and opening 65 with eighteen and three fourths right hand threads per inch, portion 66 and opening 67 with nine and three eights left hand threads per inch and portion 68 and opening 69 with four and eleven sixteenths right hand threads per inch. As will now be apparent the number of threads per inch associated with each rotor 50–54 is binary weighted. For example, oscillation of the most significant rotor 54 causes sixteen times the longitudinal displacement of the actuating member 37 that is created by oscillation of the least significant rotor 50 with the longitudinal displacement of the actuating member 37 by the various rotors 50–54 being cummulative.

Figures 3, 4:
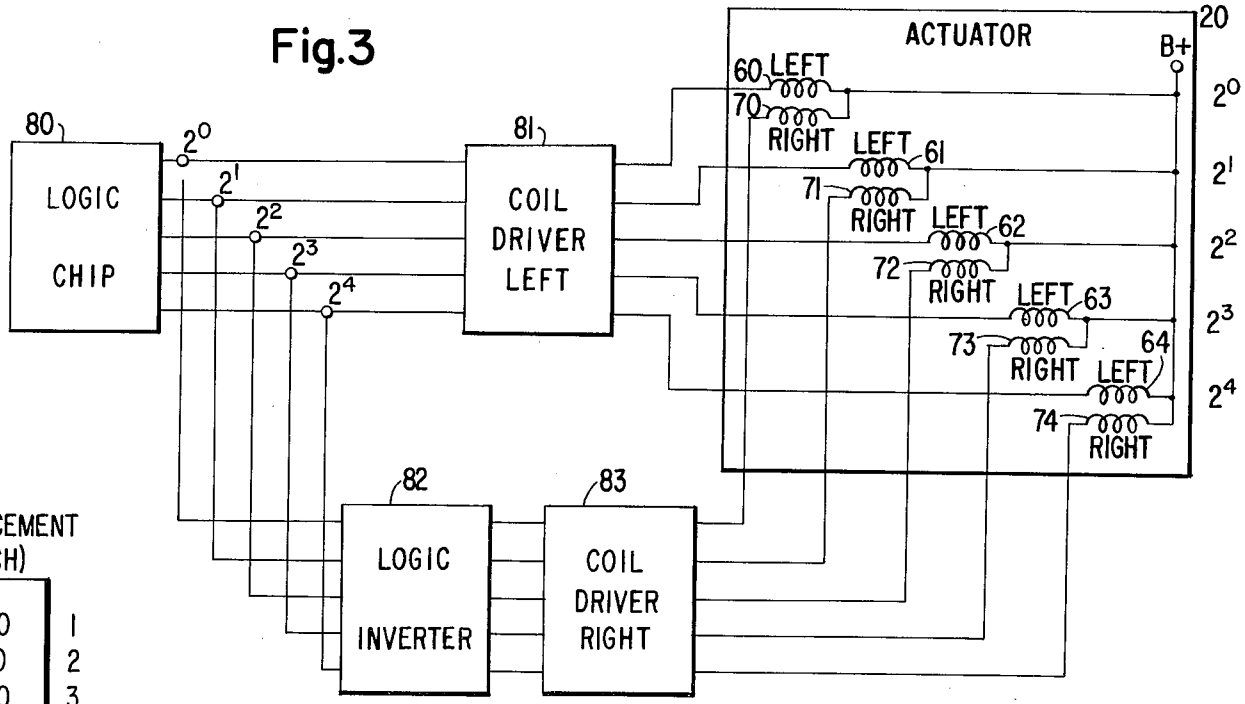
FIG. 3 is a black diagram showing one system for applying electrical actuation signals to the stepper disk adder of this invention.
FIG. 4 is a chart which shows the position of the stepper disk adder of this invention for various digital binary value inputs.

FIG. 4 is a chart that shows the displacement of the actuating member 37 for various digital binary values. As shown, for the binary number 00000 the actuating member 37 is at its full left position (37 in FIG. 2A), for the binary number 01111 the actuating member 37 is at its center position (37 in FIG. 2A) and for the binary number 11110 the actuating member 37 is at its full right position (37″ in FIG. 2A). As shown the actuating member 37 is movable between the full right and left positions in increments of one hundreds of an inch. The displacement of the actuating member 37 corresponding to a binary number of 11111 is not utilized in order that the actuating member 37 be equally moveable on each side of its center position.

A system for applying the digital binary drive signals to the coils 50–54 and 60–64 is illustrated in FIG. 3 as including a source of parallel digital binary signals from a logic chip 80 such as that utilized in an electronic sewing machine described in U.S. Pat. No. 3,855,956 the contents of which are incorporated herein by reference. The digital binary signal from the chip 80 is amplified by a left coil drive circuit 81 before being applied to coils 60–64. The digital signal from the chip 80 is inverted by an inverter 82 and then amplified by a right coil drive circuit before being applied to coils 70–74. The operation of the system shown in FIG. 3 is such that a logic ONE at any of the digit positions of the binary number supplied by the chip 80 causes the left coil drive circuit to apply an actuating current to the associated coil 60, 61, 62, 63 and/or 64. A logic ONE is converted to a logic ZERO by the inverter 82 to prevent the right coil drive circuit 83 from applying an actuating current to the associated coil 70, 71, 72, 73 and/or 74. Accordingly, a logic ONE at any of the digit positions of the binary number supplied by the chip 80 causes the north magnetic pole on the associated rotor 50, 51, 52, 53 and/or 54 to be located beneath the associated coil 60, 61, 62, 63 and/or 64. The presence of a logic ZERO at any of the digit positions of the binary number supplied by the chip prevents the left coil drive from applying an actuating current to the associated coil 60, 61, 62, 63 and/or 64. A logic ZERO is converted to a logic ONE by the inverter 82 to cause the right coil drive circuit 83 to apply an actuating current to the associated coil 70, 71, 72, 73 and/or 74. Accordingly, a logic ZERO at any of the digit positions of the binary number supplied by the chip 80 causes the north magnetic pole on the associated rotor 50, 51, 52, 53 and/or 54 to be located beneath the associated coil 70, 71, 72, 73 and/or 74. As will now be apparent, consecutive digital binary signals from the chip 80 results in oscillation of predetermined ones of the rotors 50–54 to control the length of and the speed of reciprocation of the actuating member 37 that actuates the sewing machine stitch-forming instrumentalities.

Various changes and modifications of the invention as described will be apparent to those skilled in the art without departing from the spirit and scope of this invention as defined by the following claims.

I claim:

1. A stepper disk adder comprising:

a plurality of adjacent, rotatable, disk like rotors having a common longitudinal axis of rotation;

each rotor having at least a pair of opposite polarity magnetic poles spaced apart on the periphery thereof;

a pair of spaced apart magnetic field producing coils located adjacent the periphery of each said rotor;

threaded means having an axis of rotation along said longitudinal axis threadedly coupling adjacent rotors to one another; and a source of actuating signals coupled to each said pair of magnetic field producing coils;

each said source of signals including means to alternately actuate the coils in at least some of the pair of coils to cause the associated rotor to oscillate between a first and second position whereby at least some of the plurality of rotors reciprocate along said longitudinal axis by way of said threaded means.

2. The stepper disk adder according to claim 1 wherein the rotor located at one end of said plurality of adjacent rotors is restrained from reciprocating along said longitudinal axis but the remaining rotors are not so restrained.

3. The stepper disk adder according to claim 2 further including:

a sewing machine having a frame;

a needle bar gate supported in said frame for lateral oscillation;

a needle bar supported in said gate for endwise reciprocation;

means to drive said needle bar in endwise reciprocation; and means coupling the rotor at the other end of said plurality of adjacent rotors that is not restrained from reciprocating along said longitudinal axis to said needle bar gate to drive said needle bar gate in lateral oscillation.

4. The stepper disk adder according to claim 2 further including:

a sewing machine having a frame;

stitch-forming instrumentalities in said frame;

an actuating mechanism for imparting stitch-forming movement to said stitch-forming instrumentalities;

control linkage in said sewing machine frame operatively associated with said stitch-forming instrumentalities for selectively influencing the production of a variety of patterns of stitches; and means connecting the rotor at the other end of said plurality of adjacent rotors that is not restrained from reciprocating along said longitudinal axis to said control linkage.

5. The stepper disk adder according to claim 2 further including:

a rod extending through said plurality of adjacent rotors along said longitudinal axis and around which said rotors may rotate;

a retainer rotatably secured to said rod at one end of said plurality of adjacent rotors and connected to said rotor at said one end of said plurality of adjacent rotors to restrain said rotor from reciprocating along said longitudinal axis.

6. The stepper disk adder according to claim 5 further including:

a member slidably and nonrotatably mounted on said rod at the other end of said plurality of adjacent rotors;

said member threadedly coupled to said rotor at said other end of said plurality of adjacent rotors.

7. The stepper disk adder according to claim 1 wherein alternate actuation of said coils associated with a rotor causes said coils to alternately produce a like polarity magnetic pole adjacent to the periphery of the rotor.

8. The stepper disk adder according to claim 7 wherein the magnetic pole on said rotors, which is of a polarity opposite to that created adjacent to the rotors by the coils associated therewith, oscillates between said coils is response to said coils being alternately actuated by said signals.

9. The stepper disk adder according to claim 8 wherein the coils associated with a rotor are spaced apart adjacent to the periphery of the rotor by about 90°.

10. The stepper disk adder according to claim 1 wherein at least some of said rotors include an externally threaded portion extending along said longitudinal axis that threadedly engages an internally threaded opening in an adjacent rotor.

11. The stepper disk adder according to claim 1 further including;

an inverter coupled between each said source of signals and one of said coils of the associated rotor.

12. The stepper disk adder according to claim 11 wherein said sources of signals constitute a source of parallel binary signals.

* * * * *